US009597684B2

(12) United States Patent
Vella et al.

(10) Patent No.: US 9,597,684 B2
(45) Date of Patent: Mar. 21, 2017

(54) METHOD FOR MAKING HYDROPHOBIC BARRIERS IN PAPER

(71) Applicant: XEROX CORPORATION, Norwalk, CT (US)

(72) Inventors: Sarah J. Vella, Milton (CA); Jennifer L. Belelie, Oakville (CA); Barkev Keoshkerian, Thornhill (CA); James D. Mayo, Mississauga (CA); Brynn Dooley, Toronto (CA); C. Geoffrey Allen, Waterdown (CA)

(73) Assignee: XEROX CORPORATION, Norwalk, CT (US)

( * ) Notice: Subject to any disclaimer, the term of this patent is extended or adjusted under 35 U.S.C. 154(b) by 120 days.

(21) Appl. No.: 14/599,096

(22) Filed: Jan. 16, 2015

(65) Prior Publication Data

US 2016/0207038 A1 Jul. 21, 2016

(51) Int. Cl.

| | |
|---|---|
| ***B01L 3/00*** | (2006.01) |
| ***D21H 19/46*** | (2006.01) |
| ***D21H 21/16*** | (2006.01) |
| ***D21H 23/50*** | (2006.01) |
| ***D21H 27/02*** | (2006.01) |

(52) U.S. Cl.

CPC ..... *B01L 3/502707* (2013.01); *B01L 3/5023* (2013.01); *D21H 19/46* (2013.01); *D21H 21/16* (2013.01); *D21H 23/50* (2013.01); *D21H 27/02* (2013.01); *B01L 2300/0816* (2013.01); *B01L 2300/126* (2013.01); *B01L 2300/165* (2013.01)

(58) Field of Classification Search

None

See application file for complete search history.

(56) References Cited

U.S. PATENT DOCUMENTS

| | | | | |
|---|---|---|---|---|
| 3,838,012 | A * | 9/1974 | Higgins | C12M 41/36 422/420 |
| 5,231,135 | A | 7/1993 | Machell et al. | |
| 5,621,022 | A | 4/1997 | Jaeger et al. | |
| 6,221,137 | B1 | 4/2001 | King et al. | |
| 8,377,710 | B2 | 2/2013 | Whitesides et al. | |
| 2008/0313873 | A1* | 12/2008 | Link | D04H 1/465 28/108 |
| 2011/0123398 | A1* | 5/2011 | Carrilho | B01L 3/5023 422/68.1 |

(Continued)

FOREIGN PATENT DOCUMENTS

| | | | |
|---|---|---|---|
| WO | 2008007350 | A2 | 1/2008 |
| WO | 2010003188 | A1 | 1/2010 |

(Continued)

*Primary Examiner* — Lisha Jiang

(74) *Attorney, Agent, or Firm* — MH2 Technology Law Group LLP

(57) ABSTRACT

Provided is a method of patterning a substrate. The method includes depositing, in a first predetermined pattern, hydrophobic material on a first surface of a hydrophilic substrate. The method includes permeating the hydrophobic material through a thickness of the substrate without reflowing the deposited hydrophobic material. The method includes sufficiently solidifying the permeated hydrophobic material. The sufficiently solidified hydrophobic material forms a liquid-impervious barrier that separates the substrate into at least one discrete region.

19 Claims, 11 Drawing Sheets

(56) References Cited

U.S. PATENT DOCUMENTS

| | | | | |
|---|---|---|---|---|
| 2012/0198684 | A1* | 8/2012 | Carrilho | B01L 3/502707 29/527.1 |
| 2013/0084630 | A1 | 4/2013 | Rolland et al. | |

FOREIGN PATENT DOCUMENTS

| | | | |
|---|---|---|---|
| WO | 2010022324 | A2 | 2/2010 |
| WO | 2013071301 | A1 | 5/2013 |

* cited by examiner

METHOD FOR MAKING HYDROPHOBIC BARRIERS IN PAPER

FIELD

This disclosure is generally directed to methods for fanning microfluidic devices, including methods of patterning substrates, including methods of patterning a porous, hydrophilic substrate into hydrophobic and hydrophilic regions.

BACKGROUND

Paper-based microfluidic analytical devices are attractive for use in settings where conventional laboratory diagnostics are unsuitable or undesirable, for example, in developing regions, remote regions, emergency situations, and home healthcare. Paper-based devices comprise paper, wax, and assay reagents that are pre-deposited onto the paper. Typically, hydrophobic regions patterned in the paper substrate may define isolated hydrophilic zones of the paper substrate for conducting, for example, biological assays, or hydrophilic channels that may direct the movement of fluid to an assay zone.

Known methods for fanning such regions include printing, for example, via jetting, of wax-based ink onto the surface of a paper substrate, followed by heating of the substrate to melt (reflow) the wax through the thickness of the paper, leading to the formation of hydrophobic barriers that define hydrophilic regions of paper substrate. Because the conventional, wax-based inks are designed to stay on top of paper after being jetted, the heating step is necessary so that the wax reflows to penetrate the thickness of the paper to create the isolated hydrophilic zones.

One limitation of such a method is that the conventional wax ink must be melted (reflowed) after it is deposited on the substrate in order to penetrate into the substrate, and such melted wax ink spreads isotropically through the paper. This leads to more steps to form the patterns in the substrate, and the isotropic spreading, leads to larger features with lower resolution than originally printed. Accordingly, a method for patterning substrates that overcomes such limitations would be a welcome improvement in the art.

SUMMARY

In an embodiment, there is a method of patterning a substrate. The method includes depositing, in a first predetermined pattern, hydrophobic material on a first surface of a hydrophilic substrate. The method further includes permeating the hydrophobic material through a thickness of the substrate without reflowing the deposited hydrophobic material. The method further includes sufficiently solidifying the permeated hydrophobic material. The sufficiently solidified hydrophobic material forms a liquid-impervious barrier that separates the substrate into at least one discrete region.

In another embodiment, there is a method of forming a microfluidic device. The method includes depositing, in a first predetermined pattern, a hydrophobic material on a first surface of a hydrophilic substrate. The method further includes permeating the hydrophobic material through a thickness of the substrate without reflowing the deposited hydrophobic material. The method further includes forming a liquid-impervious barrier by sufficiently solidifying the permeated hydrophobic material. The substrate may include a sample receiving region, an assay region and a channel region.

Advantages of at least one embodiment include improved resolution of printed features that form hydrophobic barriers. An advantage of at least one embodiment includes improved integrity of hydrophobic barriers. An advantage of an embodiment includes methods that provide for the fabrication of patterned hydrophobic barriers that are impervious to liquids used in performing assays.

Additional advantages of the embodiments will be set forth in part in the description which follows, and in part will be understood from the description, or may be learned by practice of the embodiments. The advantages will be realized and attained by means of the elements and combinations particularly pointed out in the appended claims.

It is to be understood that both the foregoing general description and the following detailed description are exemplary and explanatory only and are not restrictive of the embodiments, as claimed.

The accompanying drawings, which are incorporated in and constitute a part of this specification, and together with the descriptions, serve to explain the principles of the embodiments.

DESCRIPTION OF THE EMBODIMENTS

Figure 1A:
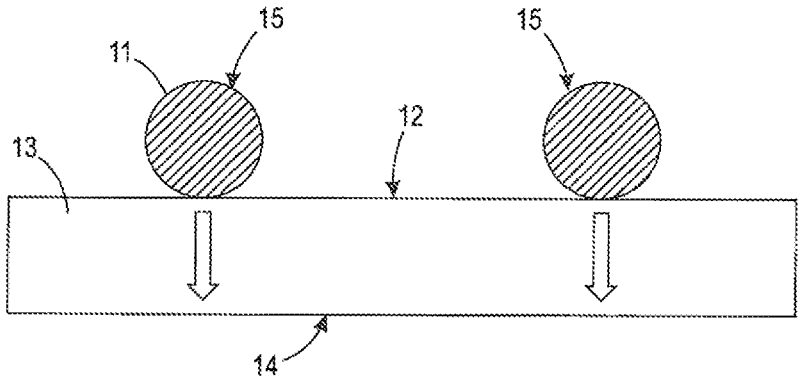
FIGS. 1A-1B illustrate performing a method of patterning a substrate according to an embodiment.

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. ~1, ~2, ~3, ~10, ~20, ~30, etc.

The following embodiments are described for illustrative purposes only with reference to the Figures. Those of skill in the art will appreciate that the following description is exemplary in nature, and that various modifications to the parameters set forth herein could be made without departing from the scope of the present embodiments. It is intended that the specification and examples be considered as examples only. The various embodiments are not necessarily mutually exclusive, as some embodiments can be combined with one or more other embodiments to form new embodiments.

Embodiments described herein include a method that uses a hydrophobic material, such as a solid phase-change ink, for example, a wax-based ink, that is formulated to directly wick through a hydrophilic substrate (e.g. paper) to generate hydrophobic barriers. An advantage of the embodiments is that such methods eliminate the need for a post-printing heating step that is otherwise required for wax inks that must be melted (reflowed) after being deposited. Additionally, the embodiments also provide for a higher resolution of deposited hydrophobic features as compared to, for example, such patterns that are formed according to conventional formulations that require reflowing and/or spread isotropically, or, said another way, conventional methods that utilize post-printing heating (reflowing).

As used herein the phrase "without reflowing the deposited hydrophobic material" means that no post-printing or post-depositing heating step is required to, for example, melt (reflow) hydrophobic material deposited on a substrate, such as a hydrophilic substrate. In other words, "without reflowing the deposited hydrophilic material" includes methods in which hydrophobic material deposited or printed on a substrate in a flowable phase does not become unflowable, for example, solid, after being deposited on the substrate and before penetrating through a thickness of the substrate. That is, "without reflowing the deposited hydrophobic material" provides that the hydrophobic material penetrates into a thickness of a substrate on which it is deposited directly after printing. Thus, a flowable phase of hydrophobic material that is deposited on a substrate "without reflowing" after the depositing on the substrate's surface, means that no heating step is needed to allow the hydrophobic material to flow/penetrate into and through a thickness of the substrate. In contrast, conventional methods utilize inks having properties that prevent the ink from penetrating through the substrate upon being deposited on a surface of the substrate without additional assistance. Thus, the conventional methods require a post-deposition reflowing (heat and/or pressure) step in order to change the deposited material back into a flowable phase for it to penetrate into the substrate.

As illustrated in FIGS. 1A-1B, and FIGS. 2A-2B, a method of patterning a substrate includes depositing hydrophobic material 11 in a predetermined pattern 15 on a first surface 12 of a substrate, such as a hydrophilic substrate 13. As indicated by the downward pointing arrows in FIG. 1A, the method includes permeating the hydrophobic material 11 through a thickness of the substrate 13, for example, without having to reflow the deposited hydrophobic material. In an embodiment, the permeating occurs anisotropically through the thickness of the substrate on which the hydrophobic material is deposited. It should be noted that one result of the hydrophobic material spreading anisotropically through the substrate is that a width of features formed by the hydrophobic material on a top side (e.g., first surface 12) of the substrate and a width of the features formed by the hydrophobic material on a back side (e.g., second surface 14) of the substrate will be defined by lower rate of spreading of the hydrophobic material, for example, in a direction parallel to a surface plane of the substrate as compared to a rate of spreading of the hydrophobic material through a thickness of the substrate. In other words, in an embodiment, the hydrophobic material spreads more quickly through a thickness of the substrate than it does on a surface of the substrate. While not limited to any particular embodiment, it is believed that anisotropic spreading of the hydrophobic material through a thickness of the substrate provides for higher resolution and better hydrophobic barriers (e.g., a higher concentration of hydrophobic material in a barrier formed within a narrower region of the substrate). Thus, one advantage of the anisotropic spreading of the hydrophobic material in methods described herein leads to sharper features (higher resolution) on both sides of a substrate, such as a paper substrate, and better integrity of barriers formed by the hydrophobic material within the substrate as compared to, for example, barriers formed by materials that penetrate isotropically instead of anisotropically.

Figure 1B:
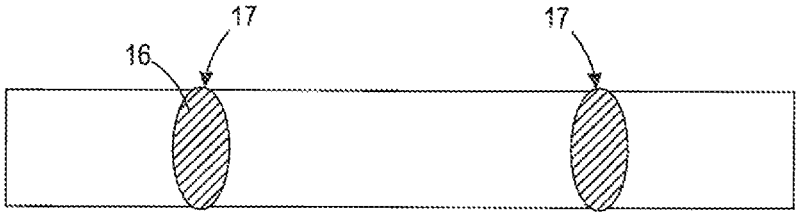

As illustrated in FIG. 1B; the hydrophobic material migrates through a thickness of the substrate 13. In an embodiment, the hydrophobic material permeates to, and deposits itself, on a second surface 14 that opposes the first surface. In the method, the permeated hydrophobic material 16 is sufficiently solidified to form a liquid-impervious barrier 17. For example, the permeated hydrophobic material phase changes to a solid, crystallizes or freezes to form barrier 17. Accordingly, in an embodiment, barrier 17 separates the substrate into at least one discrete region, that is, regions through which a liquid may permeate within the substrate but are blocked by the barrier 17 from penetrating other portions of the substrate. In an embodiment, migration of the hydrophobic material ceases at a location between the first surface and a second surface 14.

Figure 2A:
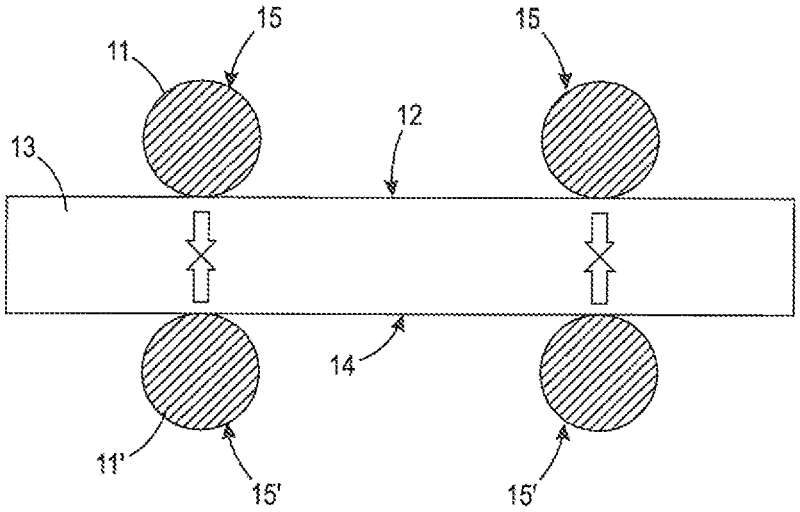
FIGS. 2A-2B illustrate performing a method of patterning a substrate according to an embodiment.
Figure 2B:
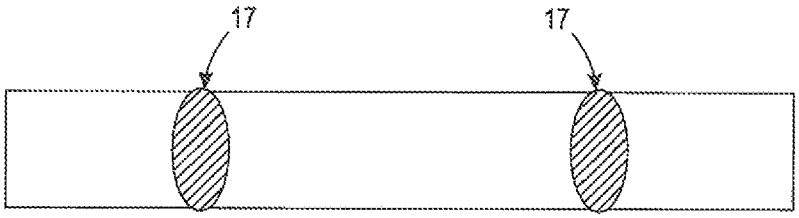

The method illustrated in FIGS. 2A-2B shows a further step, for example, a step in addition to at least one of the steps in the method illustrated in FIGS. 1A-1B. That is, FIG. 2A illustrates depositing a hydrophobic material 11 on the first surface 12 in a predetermined pattern 15 and depositing a hydrophobic material 11' in a predetermined pattern 15' on a second surface 14 of the substrate 13, wherein the second surface 14 opposes the first surface 12. A hydrophobic material 11 deposited on the first surface 12 in a predetermined pattern 15 may be the same or different, that is, may have the same or different formulation, as compared to the hydrophobic material 11'. For example, the hydrophobic materials 11 and 11' may have the same or different components, same or different ratios of components, same or different properties such as viscosity or pH, or combinations thereof. Additionally, the first predetermined pattern 15 and the second predetermined pattern 15' may be the same pattern or maybe different patterns. As described further below, the first and second predetermined patterns of hydrophilic material may be deposited by printing or stamping. In an embodiment, the first and second predetermined patterns may be formed by depositing the hydrophobic material via inkjet printing, for example, via jetting hydrophobic material through a nozzle of an inkjet printer and onto a substrate. Thus, the depositing hydrophobic material may comprise printing or stamping. In an embodiment, the depositing comprises digital printing, screen printing, flexo printing, or gravure printing. In an embodiment, the depositing includes depositing the hydrophobic material, wherein a temperature of the hydrophobic material when deposited comprises about 70° C. to about 150° C., such as a temperature of about 100° C. to about 145° C., including 130° C. to about 140° C.

As shown in FIG. 2A, at least a pardon of the pattern 15 of deposited hydrophobic material 11 and a portion of the second pattern 15' of deposited hydrophobic material 11' may overlap. For example, at least a portion of hydrophobic material 11 may be deposited in a pattern 15 at a location on first surface 12 of the substrate 13 formed opposite a location on second surface 14 on which at least a portion of hydrophobic material 11' is deposited such that a thickness of the substrate 13 separates the pattern 15 and the pattern 15'. Additionally, hydrophobic material 11' and hydrophobic material 11' may be deposited simultaneously, or one after the other. For example, pattern 15 of hydrophobic material 11 may be formed at the same time as, before, or at a later time than pattern 15' of hydrophobic material As shown in FIG. 2B, at least a portion of hydrophobic material 11 deposited in the first predetermined pattern 15 and/or a portion of hydrophobic material 11' deposited in the second predetermined pattern 15' penetrate into the substrate, for example, in at least the directions indicated by the downward pointing arrow with respect to hydrophobic material 11 and the upward pointing arrow with respect to hydrophobic material 11', and contact each other somewhere within the substrate 13. By meeting somewhere within the substrate 13, hydrophobic material 11 and hydrophobic material 11' that penetrate through a thickness of the substrate provide for the formation of a barrier 17 that forms upon sufficiently solidifying hydrophobic material 11 and hydrophobic material 11', such as via phase change to a solid.

Figure 3A:
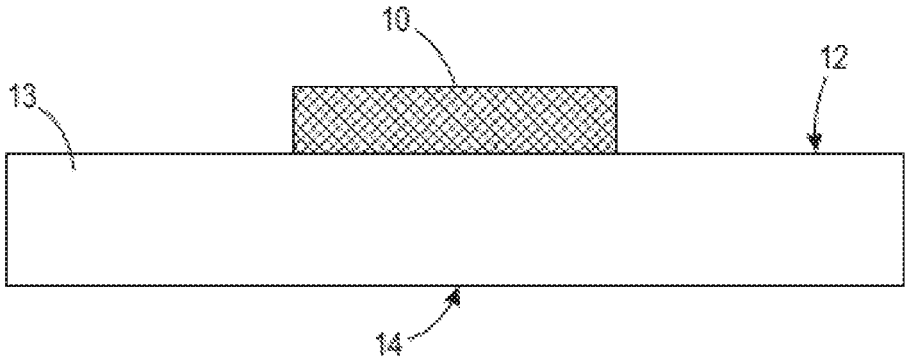
FIGS. 3A-3D illustrate performing a method of patterning a substrate according to an embodiment.
Figure 3B:
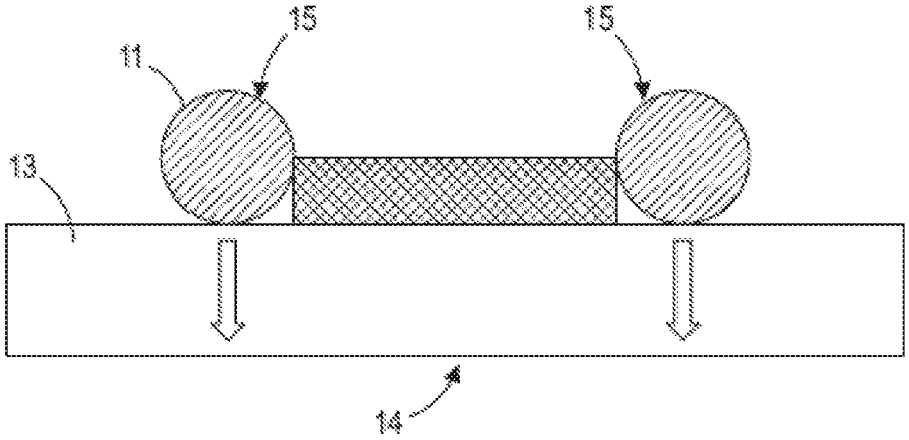
Figure 3C:
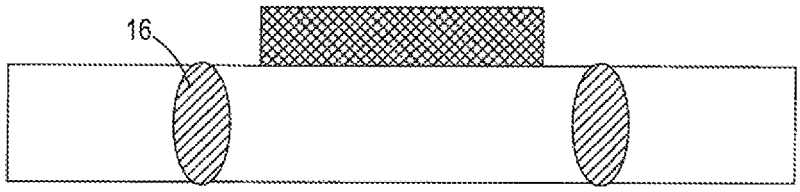
Figure 3D:
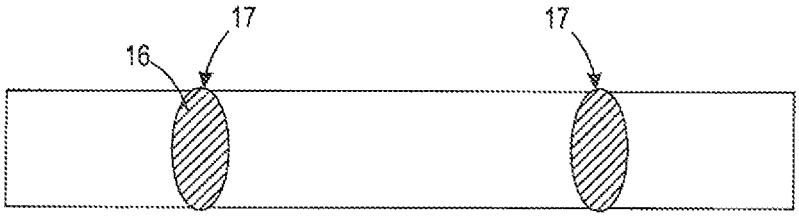

In an embodiment, the first predetermined pattern 15 and second predetermined pattern 15' may be formed by depositing hydrophobic material through a mask pattern, such as through openings of a mask pattern and onto a substrate as illustrated in FIGS. 3A-3D. For example, a method of patterning a substrate that includes, forming a mask 10 on a surface, for example, surface 12, of substrate 13 as shown in FIG. 3A. Alternatively, or in addition, hydrophobic material may be deposited on second surface 14. Mask 10 may be formed according to known methods in the art appropriate for depositing and patterning mask 10, which may depend on the material or materials selected for mask 10. Thus, depositing hydrophobic material 11 in a predetermined pattern 15, may include depositing hydrophobic material 11 through openings of mask 10 such as on a first surface 12 of a substrate 13 that is not covered by mask 10. As indicated by the downward pointing arrows in FIG. 3B, the method includes permeating the hydrophobic material 15 through a thickness of the substrate 13, for example, without having to reflow the deposited hydrophobic material. As illustrated in FIG. 3C; the hydrophobic material migrates through a thickness of the substrate 13 at least through portions underlying the surface portions of substrate 13 not covered by mask 10. In an embodiment, mask 10 may be removed in an additional step (not shown) performed between the steps illustrated in FIG. 3A and 3B, and/or in an additional step (not shown) performed between the steps illustrated in FIG. 3C and 3D. As illustrated in FIG. 3D, in an embodiment, the hydrophobic material permeates to, and deposits itself, on a second surface 14 that opposes the first surface 12. In the method, the permeated hydrophobic material is sufficiently solidified to form a liquid-impervious barrier 17. For example, the permeated hydrophobic material 16 crystallizes or freezes to form barrier 17. Accordingly, in an embodiment, barrier 17 separates the substrate into at least one discrete region. That is, barrier 17 separates the substrate into at least one discrete region through which a liquid, such as an assay sample, may permeate within the substrate. The liquid, however, is blocked (by the barrier 17) from penetrating other portions of the substrate. Thus, a barrier 17 is defined by permeation and solidification of hydrophobic material 11, the permeation beginning at surface portions of substrate 13 on which hydrophobic material is deposited, such surface portions not covered by a mask 10 and continuing through a thickness of the substrate until migration of the material ceases. In an embodiment, migration of the hydrophobic material ceases at a location between the first surface and a second surface 14.

Figure 4:
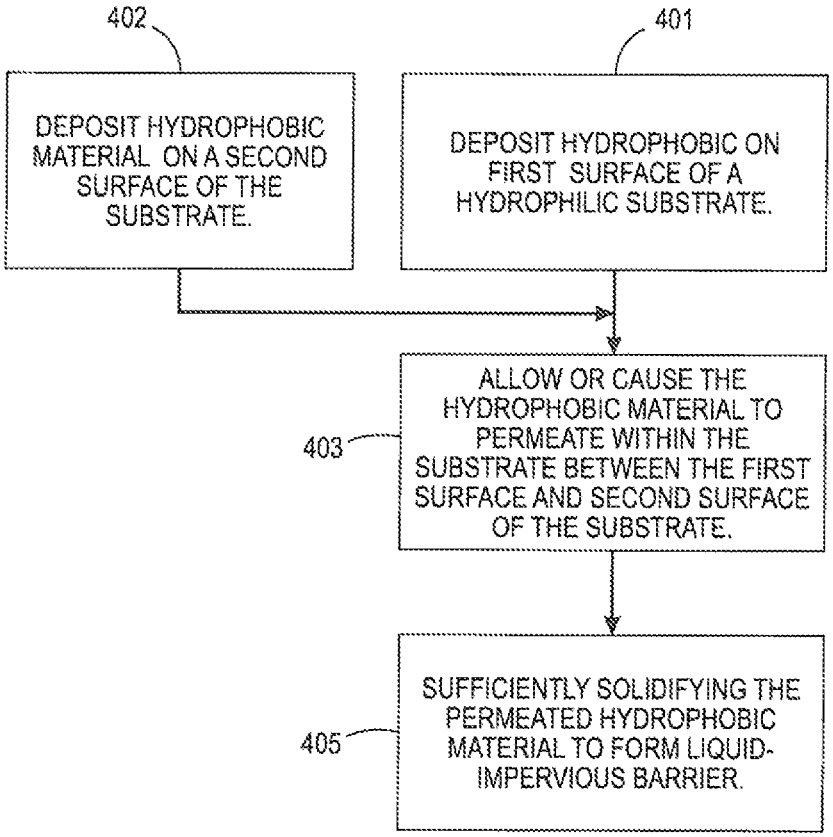
FIG. 4 is a flow-chart that describes a method of patterning a substrate according to an embodiment.

FIG. 4 includes a flow chart 400 that includes steps of a method of an embodiment. For example, at 401 hydrophobic material is deposited on a first surface of a hydrophilic substrate. In an embodiment, hydrophic material may be deposited on a second surface of the substrate as in 402. The hydrophobic material is then allowed or caused to permeate within the substrate, such as through the substrate, for example, between a first surface and a second surface of the substrate at 403. At 405, the permeated hydrophobic material is sufficiently solidified, for example, via phase change to a solid, to form a liquid impervious barrier.

Figure 5A:
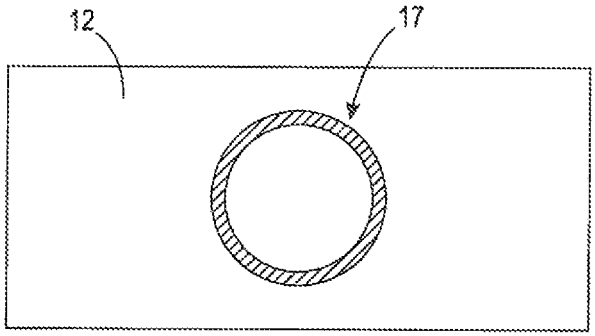
FIGS. 5A-5B illustrate a top/front view (FIG. 5A) and a bottom/back view (FIG. 5B) of a patterned substrate that may be formed according to methods of the embodiments illustrated in any of FIGS. 1A-1B, 2A-2B, or 3A-3D.
Figure 5B:
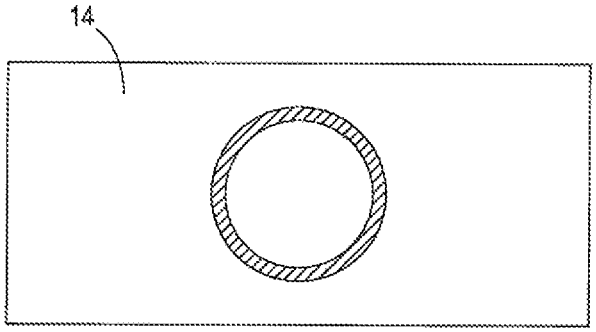

FIG. 5A is a top/front view of a substrate, showing a first surface 12 of the substrate and hydrophobic material, such as hydrophobic material 11, deposited to form a barrier 17. FIG. 5B is a bottom/back view of a substrate, showing a second surface 14 of the substrate that hydrophobic material 11 has migrated to and deposited on to form barrier 17. Thus, the combination of substrate and hydrophobic material may be selected such that practice of the methods of the embodiments allows for permeation of hydrophobic material through the substrate in such a manner that it shows-through the substrate.

Figure 6A:
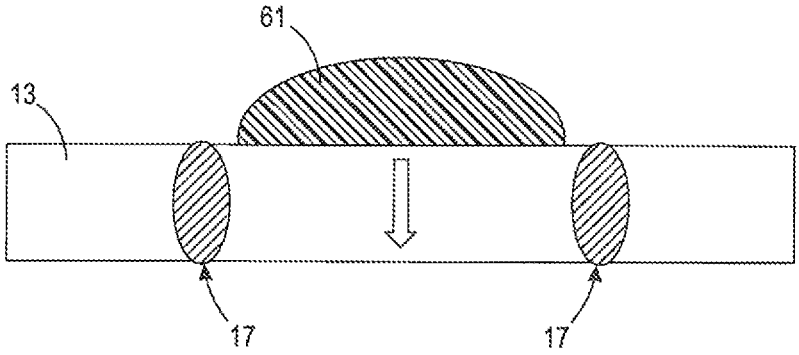
FIGS. 6A-6B illustrate liquid barrier properties of a patterned substrate that may be formed according to methods of the embodiments illustrated in any of FIGS. 1A-1B, 2A-2B, or 3A-3D, and that the liquid does not permeate past barriers.
Figure 6B:
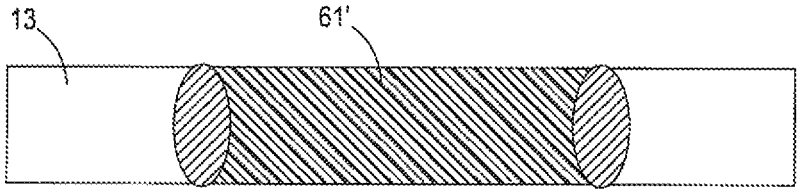
Figure 7:
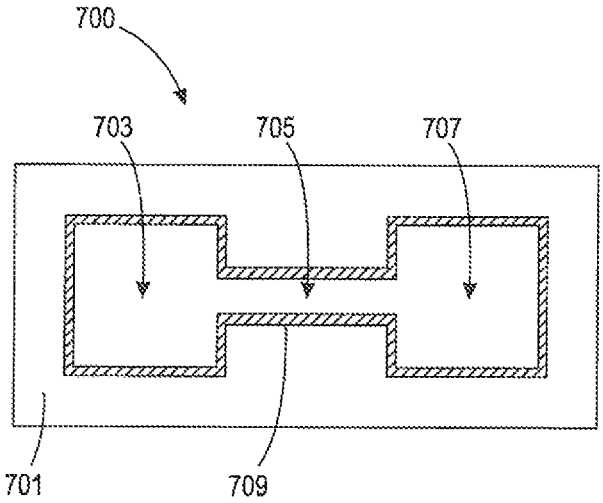
FIG. 7 illustrates an embodiment of a microfluidic device formed by patterning a substrate according to methods of the embodiments.

In an embodiment, barrier 17 is impermeable to at least some liquids, such as assay samples. For example, as shown in FIG. 6A, a liquid 61 is deposited on a surface of substrate 13 in which a barrier 17 is formed according to embodiments described above, and divides the substrate into at least on discrete portion through which the liquid 61 can permeate, such as in a direction indicated by the downward pointing arrow, between a perimeter defined by barrier 17. That is, as shown in FIG. 6B, liquid 61' can permeate through a thickness of the substrate but is blocked by barrier 17 from permeating to other portions of the substrate.

In an embodiment, there is a method of forming a microfluidic device, such as microfluidic device 700. The method can include practice of the methods described above and illustrated in FIGS. 1A-1B, FIGS. 2A-2B, FIGS. 3A-3D, and FIG. 4. In other words, the method of forming a microfluidic device can include depositing a hydrophobic material on a first surface of a hydrophilic substrate in a predetermined pattern, permeating the hydrophobic material through a thickness of the substrate without reflowing the deposited hydrophobic material, and forming a liquid-impervious barrier by sufficiently solidifying the permeated hydrophobic material. Accordingly, via practice of a method of an embodiment, the substrate 701 may be patterned to comprise a sample receiving region 703, an assay region 707 and a channel region 705. In an example, the liquid-impervious barrier may define a boundary 709 of the channel region 705 so as to provide for fluidic communication between the assay region and the sample receiving region, without allowing any liquid sample to permeate through other portions of the substrate, such as exterior to the sample receiving region, assay region and the channel region. Of course, as described above, such a method may include depositing a second hydrophobic material in a second predetermined pattern on a second surface of the substrate, wherein the second surface opposes the first surface. Further, as also described above, in the method of forming a microfluidic device, the method may include permeating the second hydrophobic material through a thickness of the substrate without reflowing the second hydrophobic material and forming the liquid-impervious barrier may further include sufficiently solidifying the permeated second hydrophobic material.

The substrate may be hydrophilic, may be porous, or may comprise a combination of hydrophilicity and porosity such that the hydrophobic material wicks through a thickness of the substrate without requiring reflowing the ink. For example, the substrate may be paper, nitrocellulose, cellulose acetate, filter paper, cloth, or a porous polymer film. The substrate may have a thickness of about 20 μm to about 500 μm.

The hydrophobic material 11, hydrophobic material 11', or both, may comprise a phase change solid ink. The phase change solid ink may comprise at least one crystalline component and at least one amorphous component. In an embodiment, the phase change solid ink may comprise at least one crystalline component, at least one amorphous component, a dye, and any combination thereof. The phase change solid ink may comprise at least one crystalline component, at least one amorphous component, a pigment, a pigment dispersant, and any combinations thereof. The ink of embodiments may further include conventional additives to take advantage of the known functionality associated with such conventional additives. Such additives may include, for example, at least one antioxidant, surfactant, defoamer, slip and leveling agents, clarifier, viscosity modifier, adhesive, plasticizer and the like.

The hydrophobic material of the embodiments may be an ink jettable phase-change solid ink composition which includes a crystalline and an amorphous components, generally in a weight ratio of from about 60:40 to about 95:5, respectively. In more specific embodiments, the weight ratio of the crystalline to amorphous component is from about 65:35 to about 95:5, or is from about 70:30 to about 90:10. In one embodiment, the weight ratio is 70:30 for the crystalline and amorphous components, respectively. In another embodiment, the weight ratio is 80:20 for the crystalline and amorphous components, respectively.

Amorphous Component

As described above, the hydrophobic material of embodiments may be a phase change solid ink composition. The phase change solid ink may include about 5 wt % to about 40 wt % amorphous component, such as about 10 wt % to about 30 wt % amorphous component, or more specifically, about 15 wt % to about 25 wt % amorphous component.

Examples of suitable amorphous materials that may serve as the amorphous component are illustrated in Table 1.

TABLE 1

| Compound | Structure | Tg (° C.)* | η @140° C. (cps) | MW (g/mol) |
|---|---|---|---|---|
| 1 | 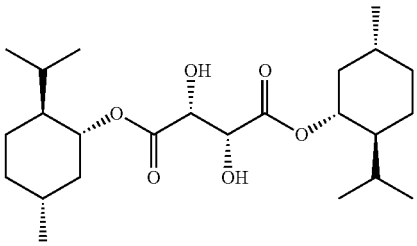 | 19 | 10 | 426.59 |
| 2 | 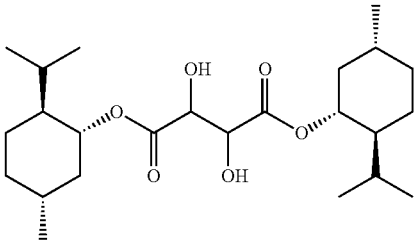 | 18 | 10 | 426.59 |

TABLE 1-continued

| Compound | Structure | Tg (° C.)* | η @140° C. (cps) | MW (g/mol) |
|---|---|---|---|---|
| 3 | 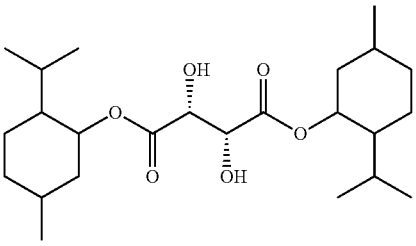 | 13 | 10 | 426.59 |
| 4 | 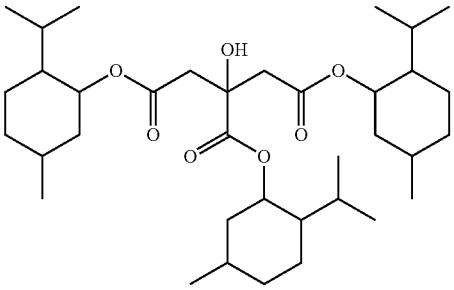 | 11 | 27 | 606.87 |
| Target | | 10-50° C. | <100 cps | <1000 g/mol |

*DSC method = 10° C./min from −50° C. to 200° C. to −50° C.; midpoint values are quoted.
**The rheology was measured on a RFS3 Rheomter (TA instruments), using a 25 mmPP plate, at a frequency of 1 Hz.

Crystalline Component

As described above, the hydrophobic material of the embodiments may be a phase change solid ink composition. The phase change solid ink may include about 60 wt % to about 95 wt % crystalline component, such as about 70 wt % to about 90 wt % crystalline component, or more specifically, about 75 wt % to about 85 wt % crystalline component.

Examples of suitable crystalline materials that may serve as the crystalline component are illustrated in Table 2.

TABLE 2

| Compound | Structure | $T_{melt}$ (° C.)* | $T_{crys}$ (° C.)* | ΔT | η @140° C. (cps)** | η @ RT (cps)** |
|---|---|---|---|---|---|---|
| 5 | 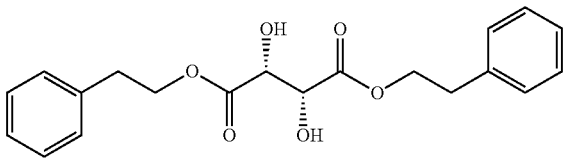 | 110 | 83 | 27 | 4.7 | $>10^6$ |
| 6 | 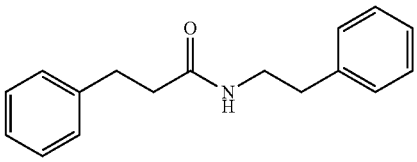 | 98 | 71 | 27 | 2.9 | $>10^6$ |
| 7 | 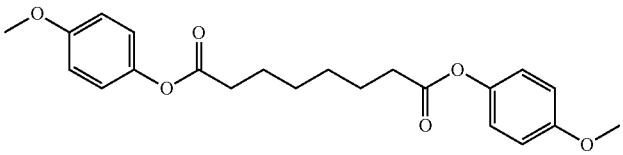 | 119 | 80 | 39 | 3.3 | $>10^6$ |

TABLE 2-continued

| Compound | Structure | $T_{melt}$ (° C.)* | $T_{crys}$ (° C.)* | ΔT | η @140° C. (cps)** | η @ RT (cps)** |
|---|---|---|---|---|---|---|
| 8 | 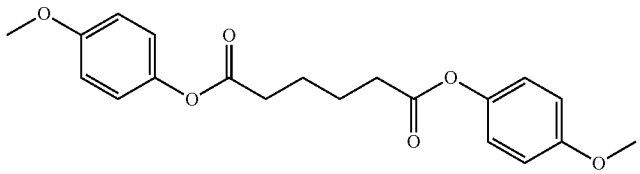 | 125 | 75 | 50 | 3.0 | $>10^6$ |
| Target | | <140° C. | >65° C. | ≤50° C. | <10 cps | $>10^6$ cps |

*DSC method = 10° C./min from −50° C. to 200° C. to −50° C.; midpoint values are quoted.

**The rheology was measured on a RFS3 Rheomter (TA instruments), using a 25 mmPP plate, at a frequency of 1 Hz.

Colorant

As described above, the hydrophobic material of embodiments may be a phase change solid ink composition. In embodiments, the phase change ink compositions described herein may optionally include a colorant. Any desired or effective colorant can be employed in the phase change ink compositions, including dyes, pigments, mixtures thereof, and the like, provided that the colorant can be dissolved or dispersed in the ink carrier. Any dye or pigment may be chosen, provided that it is capable of being dispersed or dissolved in the ink carrier and is compatible with the other ink components. The colorants can he either from the cyan, magenta, yellow, black (CMYK) set or from spot colors obtained from custom color dyes or pigments or mixtures of pigments. Dye-based colorants are miscible with the ink base composition, which comprises the crystalline and amorphous components and any other additives.

The phase change solid ink may include about 0.1 wt % to about 50 wt % of colorant, such as about 0.2 wt % to about 20 wt % of colorant, or more specifically, about 0.5 wt % to about 10 wt % of colorant.

The phase change ink compositions of embodiments can be used in combination with conventional phase change ink colorant materials, such as Color Index (C.I.) Solvent Dyes, Disperse Dyes, modified Acid and Direct Dyes, Basic Dyes, Sulphur Dyes, Vat Dyes, and the like. Examples of suitable dyes include Neozapon Red 492 (BASF); Orasol Red G (Pylam Products); Direct Brilliant Pink B (Oriental Giant Dyes); Direct Red 3BL (Classic Dyestuffs); Supranol Brilliant Red 3BW (Bayer AG); Lemon Yellow 6G (United Chemie); Light Fast Yellow 3G (Shaanxi); Aizen Spilon Yellow C-GNH (Hodogaya Chemical); Bemachrome Yellow GD Sub (Classic Dyestuffs); Cartasol Brilliant Yellow 4GF (Clariant); Cibanone Yellow 2G (Classic Dyestuffs); Orasol Black RLI (BASF); Orasol Black CN (Pylam Products); Savinyl Black RLSN (Clariant); Pyrazol Black BG (Clariant); Morfast Black 101 (Rohm & Haas); Diaazol Black RN (ICI); Thermoplast Blue 670 (BASF); Orasol Blue GN (Pylam Products); Savinyl Blue GLS (Clariant); Luxol Fast Blue MBSN (Pylam Products); Sevron Blue 5GMF (Classic Dyestuffs); Basacid Blue 750 (BASF); Keyplast Blue (Keystone Aniline Corporation); Neozapon Black X51 (BASF); Classic Solvent Black 7 (Classic Dyestuffs); Sudan Blue 670 (C.I. 61554) (BASF); Sudan Yellow 146 (C.I. 12700) (BASF); Sudan Red 462 (C.I. 26050) (BASF); C.I. Disperse Yellow 238; Neptune Red Base NB543 (BASF, C.I. Solvent Red 49); Neopen Blue FF-4012 (BASF); Lampronol Black BR (C.I. Solvent Black 35) (ICI); Morton Morplas Magenta 35 (C.I. Solvent Red 172); metal phthalocyanine colorants such as those disclosed in U.S. Pat. No. 6,221,137, the disclosure of which is totally incorporated herein by reference, and the like. Polymeric dyes can also be used, such as those disclosed in, for example, U.S. Pat. Nos. 5,621,022 and 5,231,135, the disclosures of each of which are herein entirely incorporated herein by reference, and commercially available from, for example, Milliken & Company as Milliken Ink Yellow 869, Milliken Ink Blue 92, Milliken ink Red 357, Milliken Ink Yellow 1800, Milliken Ink Black 8915-67, uncut Reactint Orange X-38, uncut Reactint Blue X-17, Solvent Yellow 162, Acid Red 52, Solvent Blue 44, and uncut Reactint Violet X-80.

Generally, suitable pigments may be organic materials or inorganic. Magnetic material-based pigments are also suitable. Magnetic pigments include magnetic nanoparticles, such as for example, ferromagnetic nanoparticles. Examples of suitable pigments include PALIOGEN Violet 5100 (BASE); PALIOGEN Violet 5890 (BASF); HELIOGEN Green L8730 (BASF); LITHOL Scarlet D3700 (BASE); SUNFAST Blue 15:4 (Sun Chemical); Hostaperm Blue B2G-D (Clariant); Hostaperm Blue B4G (Clamant); Permanent Red P-F7RK; Hostaperm Violet BL (Clariant); LITHOL Scarlet 4440 (BASF); Bon Red C (Dominion Color Company); ORACET Pink RE (BASF); PALIOGEN Red 3871 K (BASF); SUNFAST Blue 15:3 (Sun Chemical); PALIOGEN Red 3340 (BASF); SUNFAST Carbazole Violet 23 (Sun Chemical); LITHOL Fast Scarlet L4300 (BASF); SUNBRITE Yellow 17 (Sun Chemical); HELIOGEN Blue L6900, L7020 (BASF); SUNBRITE Yellow 74 (Sun Chemical); SPECTRA PAC C Orange 16 (Sun Chemical); HELIOGEN Blue K6902 7, K6910 (BASF); SUNFAST Magenta 122 (Sun Chemical); HELIOGEN Blue D6840, D7080 (BASF); Sudan Blue OS (BASF); NEOPEN Blue FF4012 (BASF); PV Fast Blue B2GO1 (Clariant); IRGALITE Blue GLO (BASF); PALIOGEN Blue 6470 (BASF); Sudan Orange G (Aldrich); Sudan Orange 220 (BASF); PALIOGEN Orange 3040 (BASF); PALIOGEN Yellow 152, 1560 (BASF); LITHOL Fast Yellow 0991 K (BASF); PALIOTOL Yellow 1840 (BASF); NOVOPERM Yellow FGL (Clariant); Ink Jet Yellow 4G VP2532 (Clariant); Toner Yellow HG (Clariant); Yellow D0790 (BASF); Suco-Yellow L1250 (BASF); Suco-Yellow D1355 (BASF); Suco Fast Yellow D1355, D1351 (BASF); HOSTAPERM Pink E 02 (Clariant); Hansa Brilliant Yellow 5GX03 (Clariant); Permanent Yellow GRL 02 (Clariant); Permanent Rubine L6B 05 (Clariant); FANAL Pink D4830 (BASF); CINQUASIA Magenta (DU PONT); PALIOGEN Black L0084 (BASF); Pigment Black K801 (BASF); and carbon blacks such as REGAL 330™ (Cabot), Nipex 150 (Evonik) Carbon Black 5250 and Carbon Black 5750 (Columbia Chemical), and the like, as well as mixtures thereof.

Pigment dispersions in the ink base may be stabilized by synergists and dispersants. Thus, the phase change ink compositions of embodiments may optionally include a pigment dispersant, for example, in combination with the pigment described above. The phase change solid ink may include about 0.1 wt % to about 25 wt % of pigment dispersant, such as about 0.5 wt % to about 10 wt % of pigment dispersant, or more specifically, about 1 wt % to about 6 wt % of pigment dispersant. Pigment dispersants may include, but are not limited to, MODAFLOW 2100, available from Cytec Surface Specialties, OLOA 1200, OLOA 11000, OLOA 11001, available from Chevron ORonite Company LLC, SOLSPERSE 9000, 16000, 17000, 17940, 18000, 19000, 19240, 20000, 34750, 36000, 39000, 41000, 54000 available from Lubrizol Corporation, and mixtures thereof.

EXAMPLES

Example 1

Exemplary Ink Formulations

Two solid inks were formulated. Formulation 1 included: 78% DST, 20% Resin (Sylvatec Re-25), and 2% dye (solvent blue 101). Formulation 2 included: 78% DST, 20% Resin (Sylvatec Re-40), 2% dye (Savinyl black RLS)).

The ink formulation were prepared by mixing the components together, followed by heating the mixture to at least its melting point, for example from about 60° C. to about 150° C., 80° C. to about 145° C. and 85° C. to about 140° C. The heated mixture was then stirred for about 5 seconds to about 30 minutes or more, to obtain a substantially homogeneous, uniform melt, followed by cooling the ink to ambient temperature (typically from about 20° C. to about 25° C.). The inks were observed to be solid at ambient temperature.

It should be noted that the colorant may be added before the other ink components have been heated or after the ink ingredients have been heated. When pigments are the selected colorants, the molten mixture may be subjected to grinding in an attritor or ball mill apparatus to effect dispersion of the pigment in the ink carrier.

Example 2

Paper Permeation and Liquid Barrier Test

Each of the solid inks were heated to 120° C. and the molten ink was pipetted onto Whatman Chromatography Grade 1 filter paper in a circle pattern. ~10 uL of an aqueous solution of red dye (food colouring) was added to the center of the circle. The aqueous solution did not penetrate the hydrophobic barrier of the wax ink indicating that the wax ink sufficiently penetrated the thickness of the filter paper.

Example 3

Figure 8A:
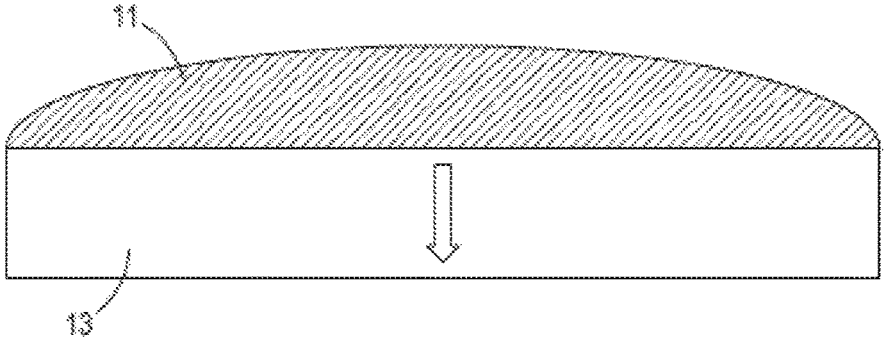
FIGS. 8A-8B shows that an exemplary hydrophobic material, such as the hydrophobic material utilized in the methods of the embodiments, penetrates into a substrate on which it is deposited.
Figure 8B:
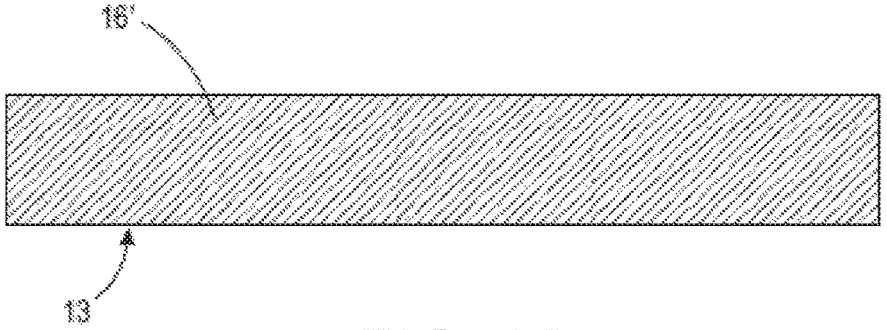
Figure 9A:
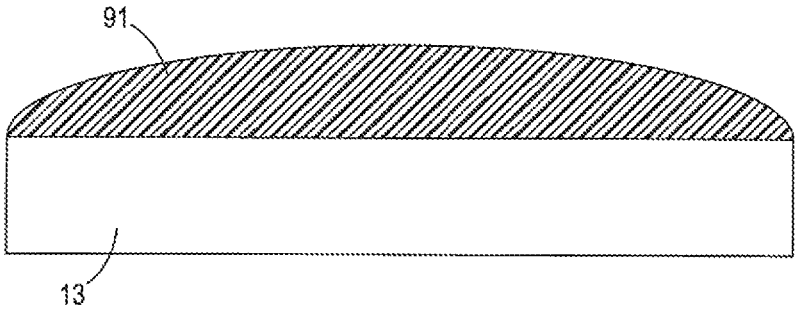
FIGS. 9A-9B illustrates that a comparative ink, such as that used in the prior art, does not penetrate into a substrate on which it is deposited.
Figure 9B:
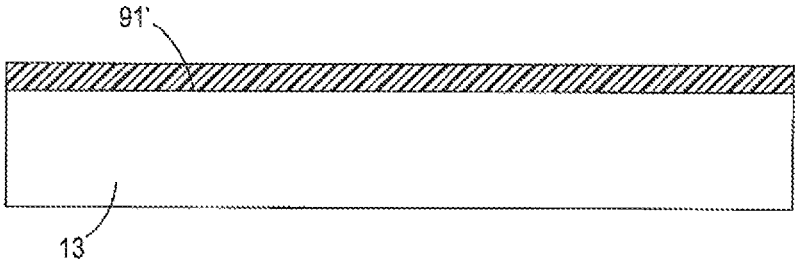

Substrate Permeation by Exemplary Hydrophobic Material versus by Commercial Ink Solid inks of formulation 1 and formulation 2 were heated to 140° C. and the molten inks were jetted using a direct-to-paper printer onto Business Commercial 4200 paper in a solid block pattern. The same block pattern was printed onto Business Commercial 4200 paper using a Phaser 8540 and commercial ink that was also heated to 140° C. Optical images comparing the thickness of cross-sections of paper prepared with Formulation 1 and commercial solid ink indicated that the Formulation 1 penetrated further into the paper than the commercial ink. FIGS. 8A-8B illustrate the deposition and resulting permeation of Formula 1 as hydrophobic material 11 deposited on substrate 13 and permeating through the substrate, settling as hydrophobic material 16' in FIG. 8B. Meanwhile, FIGS. 9A-9B illustrate the deposition of the commercial ink as material 91 deposited on substrate 13, and with no permeation through the substrate, settling as material 91' on substrate 13 in FIG. 8B.

Figure 10:
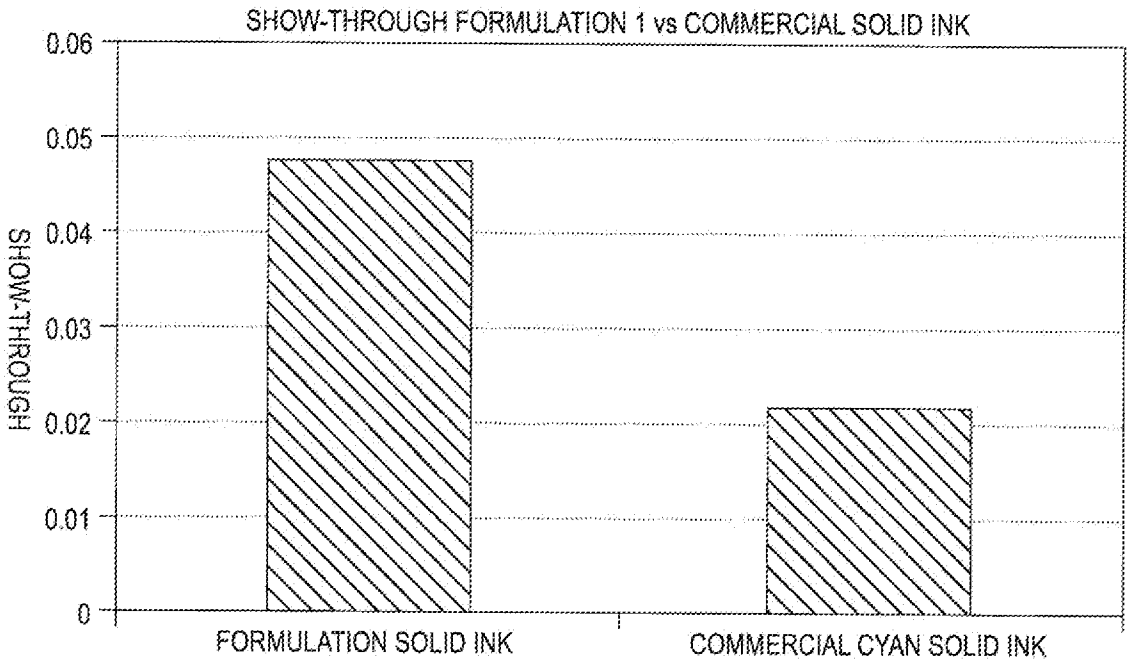
FIG. 10 is a graph showing a comparison of measured show-through of an exemplary hydrophobic material and a comparative commercial ink.

The graph of FIG. 10 shows that measured show-through of Formulation 1 (0.05) was higher that of the commercial solid ink (0.02) which also supports better paper penetration by Formulation 1 compared to commercial solid ink (FIG. 3), Show-through is calculated by measuring the difference in optical density between the backside of the paper and the front side of the paper with one blank sheet of paper on top of it divided by the optical density of the front side to normalize the result.

Example 4

Resolution Measurements

A direct printing method of an embodiment, wherein no reflowing of the deposited hydrophobic material was performed, generated hydrophobic barriers having improved resolution as compared to barriers formed according to a conventional method in which ink is printed, then melted (reflowed). All printed patterns were generated from the same file. A comparison of average wall thicknesses of the barriers, measured from optical images of the front and back side of the paper substrates is provided in Table 1. Barriers were generated using the method of embodiments, wherein reflow of the deposited hydrophobic material of Formulation 1 was not performed.

TABLE 1

| Measurement # | Description | Avg. Wall Thickness (μm) |
|---|---|---|
| 1 | Formulation 1 - Substrate Top/Front view | 689 +/− 28 |
| 2 | Formulation 1 - Substrate Bottom/Back view | 609 +/− 35 |
| 3 | Commercial Ink (before heating/reflow) - Substrate Top/Front view | 742 +/− 24 |
| 4 | Commercial Ink (after heating/reflow) - Substrate Top/Front View | 1217 +/− 55 |
| 5 | Commercial Ink (after heating/reflow) - Substrate Bottom/Back view | 1186 +/− 26 |

The average wall thickness of barriers formed from the Formulation 1 ink was 649±23 μm (average of the front and back of the print). Meanwhile, the average wall thickness of barriers formed via the comparative method, in which the deposited commercial ink was reflowed after being deposited on a substrate, was 1202±21 μm. The feature size of the commercial ink increased by 1.6 fold after heating (742±24 μm to 1202±21 μm).

While the present teachings have been illustrated with respect to one or more implementations, alterations and/or modifications may be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages may be added or existing structural components aid/or processing stages may be removed or modified.

Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items may be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "about" indicates that the value listed may be somewhat altered, as long as the alteration does not result nonconformance of the process or structure to the illustrated embodiment. Finally, "exemplary" indicates the description is used as an example, rather than implying that it is an ideal.

Furthermore, to the extent that the terms "including", "includes", "having", "has", "with", or variants thereof are used in either the detailed description and the claims, such terms are intended to be inclusive in a manner similar to the to "comprising." As used herein, the phrase "one or more of", for example, A, B, and C means any of the following: either A, B, or C alone; or combinations of two, such as A and B, B and C, and A and C; or combinations of three A, B and C.

Other embodiments will be apparent to those skilled in the art from consideration of the specification and practice of the descriptions disclosed herein. It is intended that the specification and examples be considered as exemplary only, with a true scope and spirit of the embodiments being indicated by the following claims.

What is claimed is:

1. A method of patterning a substrate, comprising depositing, in a first predetermined pattern, a flowable phase of hydrophobic material on a first surface of the substrate, wherein the substrate is a hydrophilic substrate and the hydrophobic material comprises a phase change solid ink;

permeating the hydrophobic material through a thickness of the substrate without reflowing the deposited hydrophobic material; and sufficiently solidifying the permeated hydrophobic material, wherein the sufficiently solidified hydrophobic material forms a liquid-impervious barrier that separates the substrate into at least one discrete region.

2. The method of claim 1, wherein the hydrophobic material permeates to and deposits itself on a second surface of the substrate that opposes the first surface of the substrate.

3. The method of claim 1, wherein migration of the hydrophobic material ceases at a location between the first surface and a second surface, of the substrate, wherein the second surface opposes the first surface.

4. The method of claim 1, further comprising depositing, in a second predetermined pattern, a flowable phase of hydrophobic material on a second surface of the substrate, wherein the second surface opposes the first surface.

5. The method of claim 4, wherein the hydrophobic material deposited on the first surface and the hydrophobic material deposited on the second surface comprise the same formulation.

6. The method of claim 4, wherein the hydrophobic material deposited on the first surface and the hydrophobic material deposited on the second surface comprise different formulations.

7. The method of claim 4, wherein at least a portion of the first predetermined pattern of deposited hydrophobic material and a portion of the second predetermined pattern of deposited hydrophobic material overlap, and wherein a thickness of the substrate separates the first predetermined pattern and the second predetermined pattern.

8. The method of claim 4, wherein the first predetermined pattern and the second predetermined pattern comprise the same pattern.

9. The method of claim 4, wherein at least a portion of hydrophobic material deposited in the first predetermined pattern and a portion of hydrophobic material deposited in the second predetermined pattern penetrate into the substrate and contact each other within the substrate.

10. The method of claim 1, wherein the hydrophobic material wicks through a thickness of the substrate without reflowing the hydrophobic material after it is deposited.

11. The method of claim 1, wherein the phase change solid ink comprises at least one crystalline component and at least one amorphous component.

12. The method of claim 11, wherein the phase change solid ink further comprises a dye, a pigment, a pigment dispersant, or mixtures thereof.

13. The method of claim 12, wherein the phase change solid ink further comprises a surfactant.

14. The method of claim 1, wherein the substrate comprises paper, nitrocellulose, cellulose acetate, filter paper, cloth, or a porous polymer film.

15. The method of claim 1, wherein the depositing comprises printing or stamping.

16. The method of claim 1, wherein the depositing comprises digital printing, screen printing, flexo printing, or gravure printing.

17. A method of forming a microfluidic device, comprising depositing, in a first predetermined pattern, a flowable phase of hydrophobic material on a first surface of a hydrophilic substrate, permeating the hydrophobic material through a thickness of the hydrophilic substrate without reflowing the deposited hydrophobic material;

forming a liquid-impervious barrier by sufficiently solidifying the permeated hydrophobic material, wherein the hydrophilic substrate comprises a sample receiving region, an assay region and a channel region, and wherein the hydrophobic material comprises a phase change solid ink.

18. The method of claim 17, wherein the liquid-impervious barrier defines a boundary of the channel region and provides for fluidic communication between the assay region and the sample receiving region.

19. The method of claim 17, further comprising:

depositing, in a second predetermined pattern, a flowable phase of hydrophobic material on a second surface of the hydrophilic substrate, wherein the second surface opposes the first surface; and permeating the second hydrophobic material through a thickness of the hydrophilic substrate without reflowing the second hydrophobic material, wherein forming the liquid-impervious barrier further comprises sufficiently solidifying the permeated second hydrophobic material.

* * * * *